US006892402B2

(12) United States Patent
Lim

(10) Patent No.: US 6,892,402 B2
(45) Date of Patent: May 17, 2005

(54) MEN'S TOILET

(76) Inventor: DaeSong Lim, 17 Adamson Ave., Thornleigh, Sydney, NSW 2120 (AU)

( * ) Notice: Subject to any disclaimer, the term of this patent is extended or adjusted under 35 U.S.C. 154(b) by 0 days.

(21) Appl. No.: 10/281,722

(22) Filed: Oct. 28, 2002

(65) Prior Publication Data

US 2004/0078882 A1 Apr. 29, 2004

(51) Int. Cl.[7] ..... E03D 13/00
(52) U.S. Cl. ..... 4/310; 4/420; 4/645
(58) Field of Search ..... 4/301, 310, 420, 4/645

(56) References Cited

U.S. PATENT DOCUMENTS

| | | | | | |
|---|---|---|---|---|---|
| 4,091,473 | A | * | 5/1978 | Matthews et al. | 4/420 |
| 4,726,079 | A | * | 2/1988 | Signori et al. | 4/420 |
| 5,628,075 | A | * | 5/1997 | Dudnik et al. | 4/645 |

FOREIGN PATENT DOCUMENTS

| | | | |
|---|---|---|---|
| DE | 10025348 | * | 1/2001 |
| JP | 2-27029 | * | 2/1990 |
| WO | WO01/83899 | * | 11/2001 |

* cited by examiner

*Primary Examiner*—Charles E. Phillips
(74) *Attorney, Agent, or Firm*—John A. Galbreath

(57) ABSTRACT

This invention provides an automatic elevator urinal which uses sensors. Currently male users'urinate in unisex toilet bowls or in stationary male urinals so there is many occurrences of urine spilling outside the urinal or toilet bowl resulting in bad odours and unhygienic conditions and use the same amount of water as with defecation. This invention provides a solution to these problems. It provides an urinal for men which calculates the appropriate height the urinal bowl should be for each different male user and adjusts the urinal bowl height so it will be a perfect match for each individual user. This will maximise ease of use and minimise urine spillage. It comprises of the urinal bowl 1, the main sliding board 2 for the urinal to slide vertically in, the water tank 7, the motor 8 which drives the urinal bowl vertically, a proximity sensor 3 to detect a user appoaching and leaving, a height measuring sensor 4 and the control unit (hardware controller) which moves the urinal bowl vertically to a calculated appropriate value. The benefits of this invention are that it gives complete underneath cover so that it does not allow the urine to fall outside to maximise hygiene. It will also only use the necessary amount of water when flushing to minimise water usage leading to water saving.

18 Claims, 4 Drawing Sheets

MEN'S TOILET

BACKGROUND OF THE INVENTION

1. Field of Invention

The subject invention relates to male toilets and specifically to a toilet that moves vertically automatically according to the height of the person so that the toilet bowl is perfectly heighted for each individual user. Thus it will stop spillage of urine, increase comfort, increase hygiene and save water.

2. Description of the prior Art

In today's market there exists many forms of men's urinals. There are two main conventional types. First is the bowl type where there is a bowl stuck to the wall at a fixed height and is used by one individual at a time. Since this urinal is fixed, it is generally fixed at a low-middle height and thus if a user is tall then they will have problems aiming the urine into this low hanging bowl due to the great distance between the urinal bowl and the hips of the person. To correct this situation the tall person may bend his knees or back leading to discomfort for the tall person. Conversely if the fixed height is high then a child or a short person will have problems using this bowl or mav not be able to use it due to a lack of reach. Other disadvantages arising from this stationary type of urinal and this height mismatch between the user and the urinal bowl height is that, it may lead to the user completely missing the urinal bowl and much increased splashing of the urine when the urine hits the bowl with force at the wrong angle and too much height. The splashing will probably splash on the user's hand or clothes and the spillage on to the floor, thus making this urinal very unhygienic and if spillage then the floor be made slippery and thus increased danger of a person slipping as well.

The second common type of urinal is the box type which accommodates many people at once, where there is a metallic trough shaped like urinal which lies flat against the wall and where the urine will gather at the bottom of this trough to be drained. The disadvantages of this is that since the back is flat, when the urine hits this, it will splash back at the user. Also due to its open to air shape, hygiene, especially fowl smells are a big problem. Also, even if one single user used the urinal, the flush will flush the whole trough leading to water wastage.

In both of the above described urinals, in trying to minimise the splashing of the urine onto the person, the user may step away from the urinal to avoid the splashing and this will increase the risk of the urine dripping onto the side of the urinal or the floor especially when the urine jet is weak (eg. When user has nearly completed urinating).

Finally if we now look at the typical residential home, they usually do not have a separate men's urinal but the typical toilet bowl is used for both sexes for urine and faeces. Men using this typical toilet bowl as a urinal can lead to a height mismatch problem outlined before, thus common problems are missing the bowl or splashing of urine to the surrounding or the user's body or clothes. This means frequent cleaning of the bathroom is needed to keep hygiene. There is also a need for the user to lift the toilet seat up and down, before and after urinating respectively. Thus there is a chance that extra germs or urine will get onto the user and it could also make the user feel less clean, even if it maybe just mentally. Also there are many times the user will not bother to actually lift the seat resulting in urine getting on the seat.

Also another problem is a greatly magnified water wastage if a toilet bowl is used as a urinal. These toilet bowls have a water tank typically holding 13 litres of water and whether the flushing is for faeces or urine, they both use the same amount of water. Finally, when a child of typically 3 years of age learns to use the toilet by themself, they find that the height of this toilet bowl is typically too high and thus can not use it by himself.

SUMMARY OF THE INVENTION

These problems are overcome by the present invention, which provides a toilet at the perfect height for every individual so that the toilet bowl will provide absolute underneath cover by automatically moving to this perfect height from the bottom, thus will remove the common spillage and splashing urine problem. This means great improvement in hygiene. Also using this toilet will help tall people be able to straighten their backs while urinating and short people will be able to use it with more ease thus resulting in great improvement in comfort for everybody.

All the adjusting of the height of the toilet is done automatically using a system of sensors and automating mechanical mechanisms thus there is nothing for the user to worry about when using this toilet. There is no need for the user to touch the toilet in any way.

Also this toilet provides substantial water saving compared to most toilet bowls. Most toilet bowls use 13 litres per flush and since this toilet uses 4 litres, it results in a saving of 9 litres per flush. In the future, when the water resources run more scarce, this toilet will provide an alternative solution to the existing toilets.

DETAILED DESCRIPTION OF THE PREFERRED EMBODIMENTS

Figure 1:
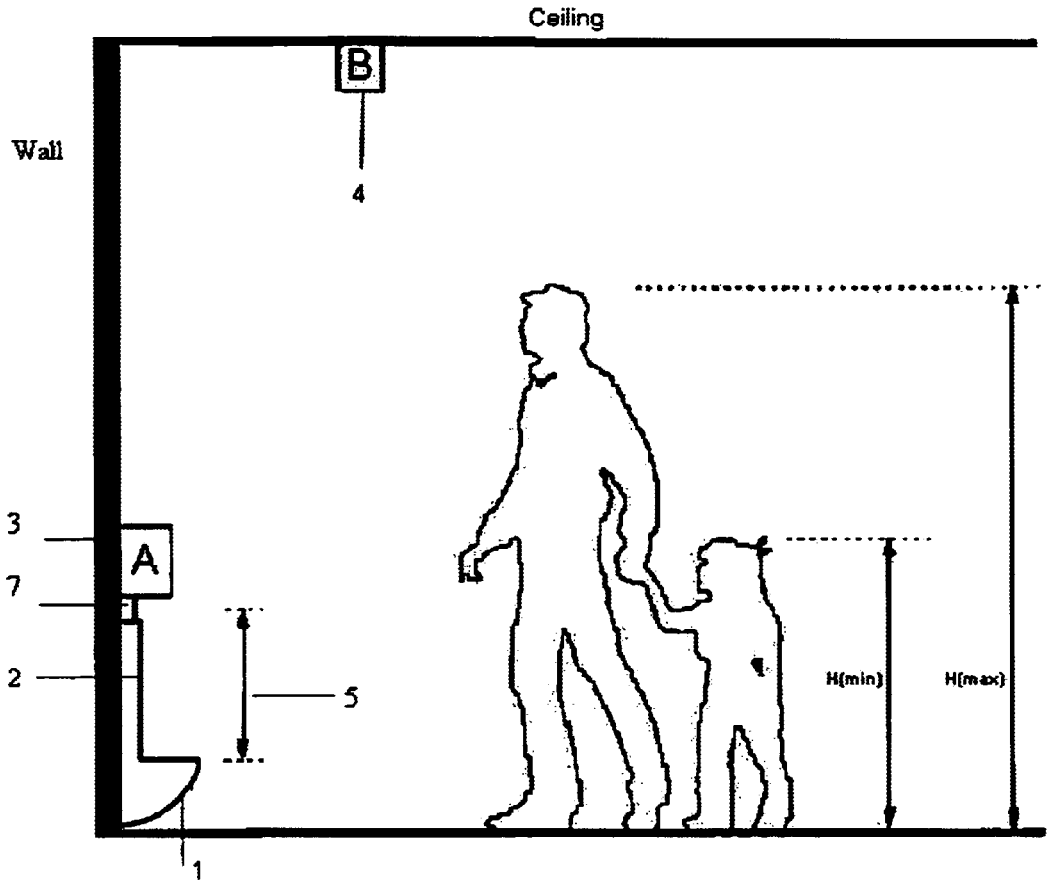
FIG. 1 shows automatic elevator men's toilet working concept

With the assistance of FIG. 1, the toilet concept in practice from the user's perspective will be described. First a person arrives to urinate. When the person is about 0.8~1.2 meters away the proximity sensor 3 detects the person's arrival and flushes the toilet.

The height sensor 4 detects the person's height 6, and passes this information to the control unit. The control unit calculates 43% of the detected height and activates the motor mechanics to drive the toilet 1 to move to the correct height for the user from its starting home(equilibrium) position. The home(equilibrium) position, is the lowest position the toilet can go, and is the position the toilet will return to after the user has finished using the toilet.

Normally, the height of a person's penis is about 43% of the person's height 6 from the ground. So the ideal height of the toilet for this user will be at or slightly below this height. Thus when children reach the age of 3 and start to use the toilet by oneself, his height maybe around 1 meter tall. (This scenario also applies if the user is very short). Then the toilet will automatically move to a height of 43cm or slightly below this height in order to be at the ideal height. Conversely if the user is a 2 meters tall person then the ideal height for the toilet will be around the height of 86cm.

Figure 2:
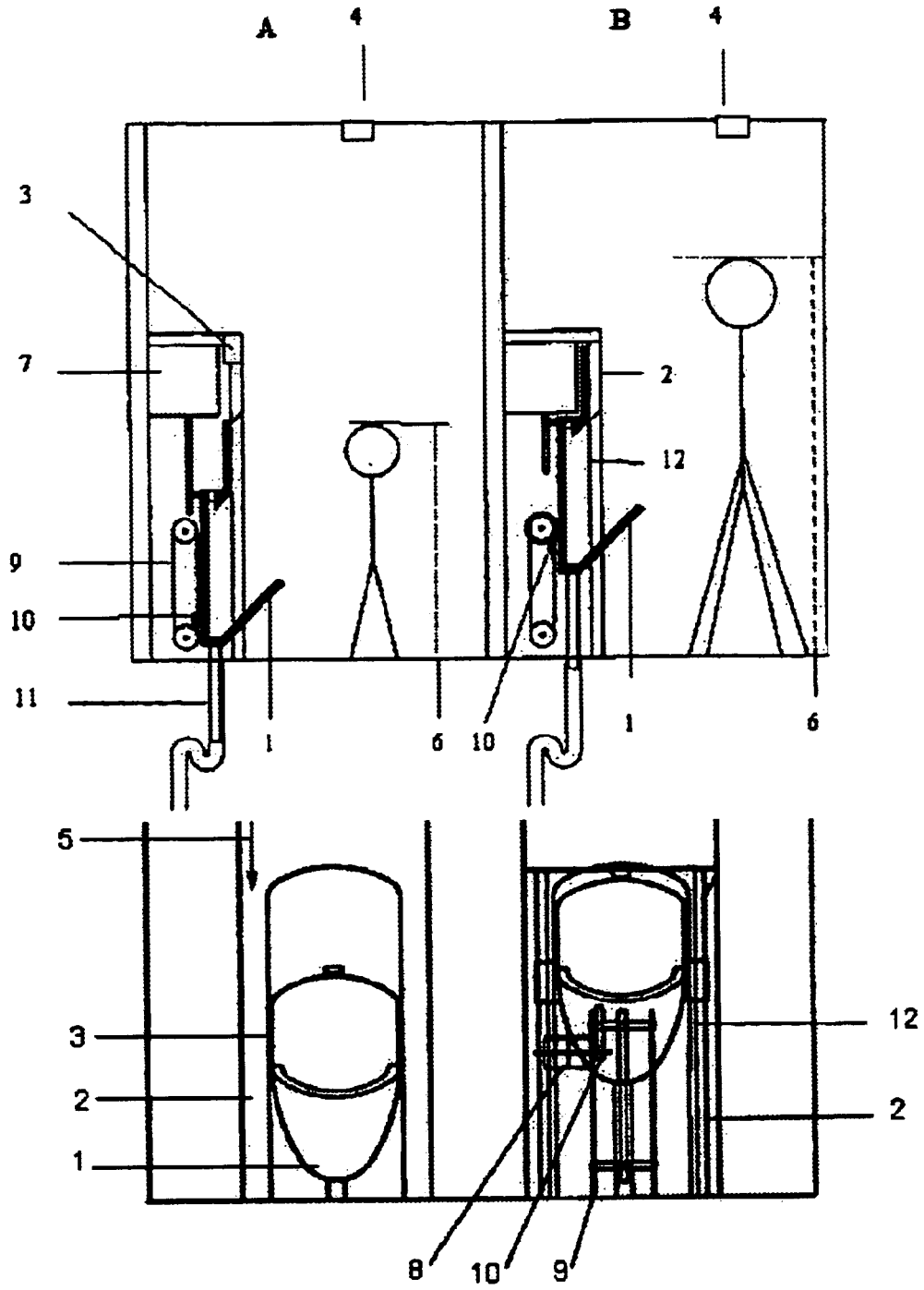
FIG. 2 shows automatic elevator men's toilet's internal mechanics

Now looking at FIG. 2, 2(A) shows a short person and the toilet at his correct position and 2(B) shows a tall person where the toilet is higher and at his correct position. 2(C) and 2(D) shows the toilets from 2(A) and 2(B) in more detail.

FIG. 2 also shows the motor mechanism for automatically moving the toilet vertically. When the motor 8 rotates one way or other, the belt 9 which is tensioned between two rollers is rotated by the motor 8. The belt loop 9 has a point where it is joined 10 to the toilet. Thus the toilet 1 is moved between the boundaries indicated by 5.

FIG. 2 also shows the usual elements needed in a urinal or toilet. On top of the toilet is the motor 8 and the water tank 7. There is a covering board 2 which hides these and other internal mechanics behind the wall. On this covering board 2, are two vertically aligned slide rails 12. The back of the toilet bowl 1 is flat and rectangular and the two vertical edges fit in these two rails 12. Thus as the toilet bowl 1 is moved vertically by the motor belt 9, it is actually sliding on these two vertical sliding rails 12. These rails 12 provide a guide for the toilet bowl's 1 vertical movement and provides strength for holding the toilet in a stable vertical position.

The draining system comprises of two pipes 11 that are interlaced so one fits inside the other. Thus as the toilet is moved vertically the inside pipe slides in and out as the pipe expands and compresses to keep the pipes 11 joined to the toilet's drain.

Figure 3:
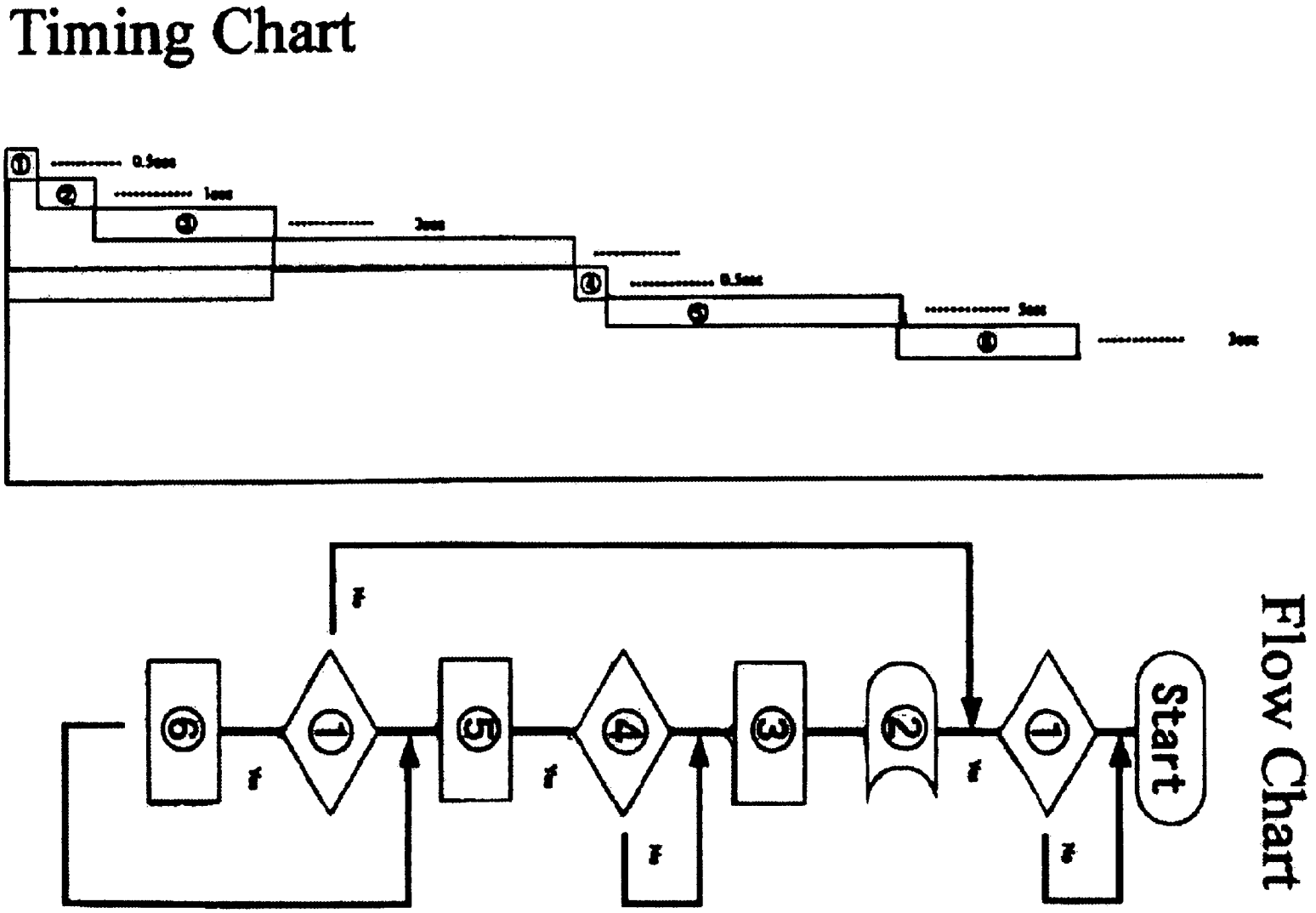
FIG. 3 shows automatic elevator men's toilet system flow chart and timing chart

Now looking at FIG. 3, it shows the flow chart outlines the functional steps the toilet proceeds through in a more formal format.

1. The user approaches the toilet
2. The height sensor detects the height
3. The control unit calculated 43% and rotates the motor to adjust the toilet bowl height.

The control unit also flushes the toilet at this time before it is used.

4. The proximity sensor is checking (waiting) to see if the user has finished urinating and stepping away from the toilet.
5. The toilet is flushed for the second time.
6. The toilet returns to its home(equilibrium) position.

An example of the time flow during these steps is shown more formally by the timing chart.

Figure 4:
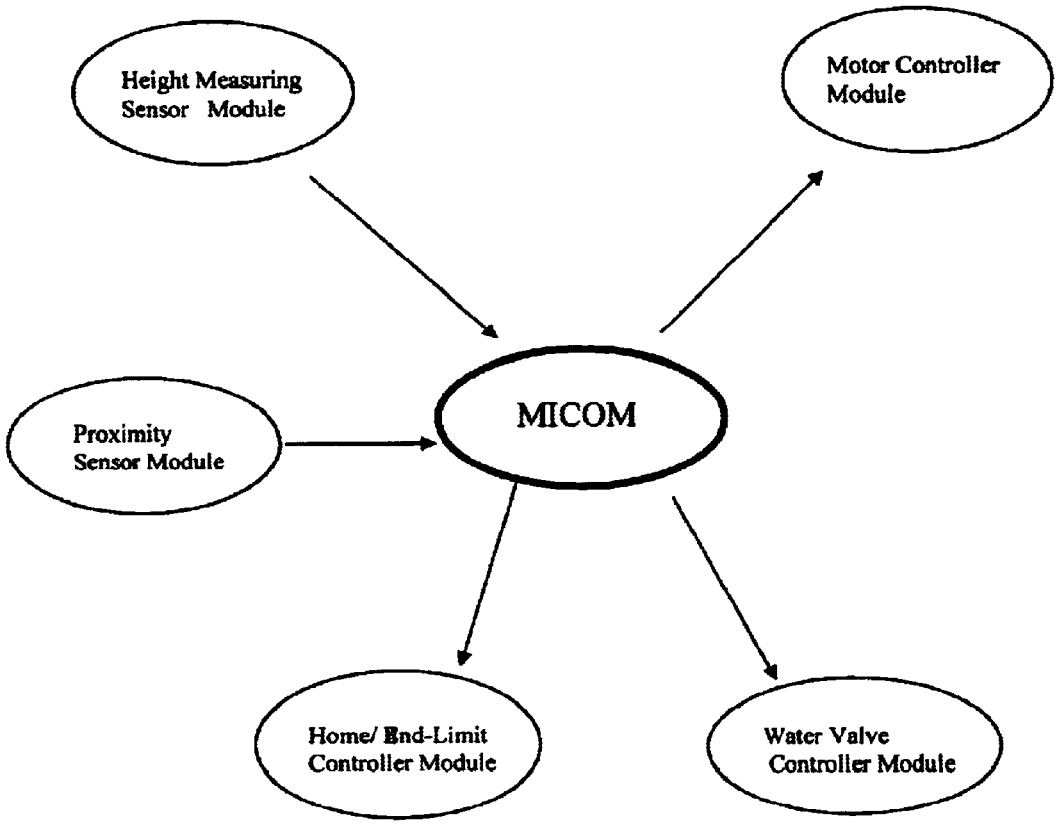
FIG. 4 shows automatic elevator men's toilet system hardware block diagram

Proceeding to FIG. 4, it shows the control unit's functional duties. The control unit is an electronic circuit designed to automate and coordinate all the operation of the toilet in a efficient way.

It receives the a signal from the proximity sensor to indicate that a person has approached 0.8~1.2 meters from the toilet. There is another signal to indicate the person leaving from the toilet.

It then activates the solenoid water valve module for an automated flush of the toilet, when any of these two signals are received.

The height measuring sensor module measuring the height and outputs the height value to the control unit. The control unit then calculates using its calculating circuit, 43% of the inputted height. The height is measured from the ground and is relative to the ground.

The control unit then passes this toilet height value as a signal to the motor control module. T he motor controller module receives the toilet height value signal and a signal to adjust the height from the control unit, and moves the motor to the toilet height specified by the signal.

Finally, the Home/End limit Module sends a signal to the control unit to tell it to move the motor to the home (equilibrium) position. The control unit in turn sends a signal to the motor controller module which moves the motor to the home(equilibrium) position.

It will be realised that there are already pre-existing automatic height measuring devices which use light emitting devices based on infra-red, laser or other light sources to calculate an objects height. It must also be realised that the height measuring module used to calculate the user's height could be an application of any of these pre-existing devices or a customised versions of them, or brand new height measuring device particularly designed for this urinal user height detecting application. The particular height sensor described in the above variation of the invention uses the light bouncing off the user's head to calculate the height of the person. However since there are many pre-existing height sensing devices, it means that the height sensor is not restricted to be fitted on the ceiling on top of where the user will stand but could be anywhere, depending on the particular height measuring module used. For example, the sensor could be a vertical strip on the wall which sends a vertical beam which is broken by the user's body. However the beams that shine above the user's head will not be broken by the user's body. Thus allowing the sensor to detect the person's height. This is just one possible alternative method for detecting the height.

It will be realised that the ideal urinal position the urinal will move to does not necessarily have to be 43% of a user's height as described above. It maybe 40%, 45%, 35% or any other percentage relative to the user's height.

It will be realised that the home(equilibrium) position for the urinal does not have to be the lowest position that the urinal can go. It can be any height such as 1, 1.2 or 0.6 meters. There may not necessarily have to be a home (equilibrium) position that the urinal returns to after use. Instead it may just sit at the last used urinal position.

It will be realised that the motor does not necessarily have to rotate a motor belt in order to move the urinal vertically. The motor belt may be substituted by other mechanics. Some examples are a chain belt, worm drive or gears.

It will be realised that the mechanism used to automate the vertical movement of the urinal is not restricted to the motor form shown in the example. Many other alternative mechanisms exist such as using a water, hydraulic or air cylinder which can move the urinal vertically as it expands and compresses.

It will be realised that the shape of the urinal bowl or the piping or other external designs displayed in the drawings will not be restricted to the form taken in the drawings provided and may take any suitable shape or form.

It will also be realised that the form of the proximity sensor used is not restricted to the light emitting devices as shown in the above example. It can take other forms such as a floor sensor placed in front of the urinal which will be triggered when the user steps on it.

To assist with the understanding of the invention, references will now be made to the accompanying drawings which show one example of the invention.

What is claimed is:

1. An automatically height adjusting men's toilet comprising of:

(a) a toilet bowl that slides up and down, (b) a mechanism that automatically moves this toilet vertically, (c) sensors to detect the height of the toilet user, (d) a control unit which calculates the appropriate height of the toilet for each toilet user, coordinates the various toilet functionalities and the automation.

2. The assembly of claim 1, wherein the automatic mechanism for vertical movement is based on a motor which rotates a belt, gears, worm drive or chain which is attached to the toilet thus rotation of the motor will move the toilet up or down depending on the direction of rotation.

3. The assembly of claim 1, wherein the automatic mechanics which powers the vertical movement of the toilet is based on water, hydraulic or pneumatic cylinder power.

4. The assembly of claim 1, wherein sensing the user's height will be done using light emitting sensors such as infra-red or laser devices on the ceiling above the position the user will stand or in any other suitable position such as the wall.

5. The assembly of claim 2, wherein the sensing the user's height will be done using light emitting sensors such as infra-red or laser devices placed on the ceiling above the position the user will stand or in any other suitable position such as the well.

6. The assembly of claim 3, wherein the sensing the user's height will be done using light emitting sensors such as infra-red or laser devices placed on the ceiling above the position the user will stand or in any other suitable position such as the wall.

7. The assembly of claim 1, wherein the toilet height adjusting is done through first measuring the user's height using a height sensor, then feeding this information to the control unit which will calculate an appropriate height of the toilet for this person, which then sends this information to a mechanics controller module, which then moves a motor, hydraulic cylinder, pneumatic cylinder, or water cylinder, so that the toilet bowl will moved to the appropriate height.

8. The assembly of claim 2, wherein the toilet height adjusting is done through first measuring the user's height using a height sensor, then feeding this information to the control unit which will calculate an appropriate height of the toilet for this person, which then sends this information to a mechanics controller module, which then moves the motor so that the toilet bowl will moved to the appropriate height.

9. The assembly of claim 3, wherein the toilet height adjusting is done through first measuring the user's height using a height sensor, then feeding this information to the control unit which will calculate an appropriate height of the toilet for this person, which then sends this information to a mechanics controller module, which then moves the hydraulic cylinder, pneumatic cylinder, or water cylinder, so that the toilet bowl will moved to the appropriate height.

10. The assembly of claim 1, wherein the appropriate height of the toilet is a percentage of a person's height such as 43% or any other percentage which is decided to be ideal.

11. The assembly of claim 2, wherein the appropriate height of the toilet is a percentage of a person's height such as 43% or any other percentage which is decided to be ideal.

12. The assembly of claim 3, wherein the appropriate height of the toilet is a percentage of a person's height such as 43% or any other percentage which is decided to be ideal.

13. The assembly ofclaim 1, wherein the assembly also includes a proximity sensor.

14. The assembly of claim 2, wherein the assembly also includes a proximity sensor.

15. The assembly of claim 3, wherein the assembly also includes a proximity sensor.

16. The assembly of claim 1, where the assembly also includes a draining system comprising two pipes that are interlaced so that one fits inside the other.

17. The assembly of claim 2, where the assembly also includes a draining system comprising two pipes that are interlaced so that one fits inside the other.

18. The assembly of claim 3, where the assembly also includes a draining system comprising two pipes that are interlaced so that one fits inside the other.

* * * * *